United States Patent [19]

Perel

[11] Patent Number: 4,776,568

[45] Date of Patent: Oct. 11, 1988

[54] NAIL PULLER

[76] Inventor: Jacob Perel, P.O. Box 103, Flushing, N.Y. 11367

[21] Appl. No.: 95,442

[22] Filed: Sep. 8, 1987

[51] Int. Cl.[4] ..... B25F 1/00

[52] U.S. Cl. ..... 254/25

[58] Field of Search ..... D8/45, 47, 48, 89; 81/44; 7/105, 166, 170; 254/18, 25, 28, 21

[56] References Cited

U.S. PATENT DOCUMENTS

| | | | |
|---|---|---|---|
| 542,989 | 7/1895 | Brooks | 254/25 |
| 918,219 | 4/1909 | Swan | 259/25 |
| 1,255,660 | 2/1918 | Stevens | 7/158 |
| 2,010,202 | 8/1935 | Santora | 254/25 |
| 2,382,831 | 8/1945 | Tabellione | 254/25 |
| 3,218,030 | 11/1965 | Baro | 254/18 |
| 4,026,521 | 5/1977 | Clark | 254/28 |
| 4,658,457 | 4/1987 | Rokita | 254/18 |

FOREIGN PATENT DOCUMENTS

| | | | |
|---|---|---|---|
| 377303 | 7/1932 | United Kingdom | 7/158 |

*Primary Examiner*—Robert C. Watson
*Attorney, Agent, or Firm*—Myron Amer

[57] ABSTRACT

A nail puller which is an assembly of a front hollow tube having a diamond-shaped end opening which fits over and engages the nail head and a handle, and having an intermediate member which extends from the handle into the end of the hollow tube opposite the nail-engaging end for completing the assembly of the nail puller.

2 Claims, 1 Drawing Sheet

NAIL PULLER

The present invention relates generally to devices for removing nails and more particularly, to an improved device in which nails may be effectively removed from such soft materials as sheet rock without causing damage to the surface of the sheet rock.

PRIOR ART

The most popular devices of this character are claw hammers, in which the claws are wedged under the nailhead and mechanical leverage exerted on the handle of the hammer to cause removal of the nail. However, the same force that is used in prying the nail loose is exerted by the head of the hammer against the surface of the material in which the nail is imbedded, which in this instance can be assumed to be sheet rock, and this force will unavoidably cause a depression or other damage to the sheet rock surface. Also, the sheet rock is usually nailed to building wooden studs and typically the nail has a shank which is several inches long. This size shank produces a considerable friction force resisting removal, and thus the tool being used to remove the nail must be structurally strong enough to resist this force that is involved. Still further, the removal tool must be able to be placed easily and quickly about the head of the nail so that the removal process is not time-consuming, particularly when sheet rock is involved since it is customary to use a plurality of spaced nails to support the sheet rock on the stud.

EXAMPLE OF PRIOR ART

U.S. Pat. No. 3,218,030 issued on Nov. 16, 1965, to J. Baro, describes a tool for removing tacks in which the tack is engaged under its head and removed by being pulled from the material in which it is imbedded, rather than being pried from this material. In this manner, there is, of course, nominal damage to the surface of the anchoring material, but it is questionable whether the substantial frictional resistance of a nail can be handled by the device of Baro. Also, the device of this patent has at the end engaging the tack, a groove bounded by comparatively thin edges which, in use, are slipped under the head of the tack. Thus, the edges of the device have to be thin in order to minimize the initial prying of the tack. Even more important, since these edges are slipped under the head of the tack, there has to be an opening at one end of the groove in order to permit this advantageous positioning of these edges beneath the head of the tack. The thinness of the edges and the opening at one end as just described are, of course, obvious structural weaknesses which disqualify the Baro device for use in connection with removing nails that attach sheet rock to the wood studs of buildings.

It is desirable to provide a nail removal apparatus or device which is capable of removing even comparatively long nails from wood studding, but in which the removal does not require extensive initial prying of the nail, and in which the removal is substantially accomplished by pulling the nail free of its engagement with the sheet rock and wood stud. This removal of the nail by pulling normal to the surface in which it is imbedded causes very little, if any, damage to the surface of the anchoring material. Additionally, it is much faster than the prior art nail-prying system, and thus can be used to remove a plurality of nails in an optimum minimum amount of time.

Still further, the inventive device hereof, has an opening at one end for engaging the nail, but the opening is bounded about its entire periphery by an encircling edge and thus, unlike the prior art devices, does not have any inherently weak structural features, which render it inappropriate for use in overcoming significant frictional resistance of screws and large-sized nails.

The improvement over prior art devices achieved by this invention is the provision of a diamond shaped end opening that can be readily placed under an end of the head of the nail and then initially rotated into a co-axial relation with the shank of the nail. During this initial rotation, the nailhead enters the end opening because dimensionally it is smaller than the largest size of the opening. However, the initial rotation also causes a slight shifting in the end opening, and, of course, also in the edges which bound the end opening. One consequence of this shift is that the nailhead is then above a smaller dimension of the end opening than prior to this shift, and thus there are edges strategically located under the head of the nail by which the nail can be pulled free of its engagement to the anchoring material.

The description of the invention which follows, together with the accompanying drawings should not be construed as limiting the invention to the example shown and described, because those skilled in the art to which this invention appertains will be able to devise other forms thereof within the ambit of the appended claims.

Figure 6A:
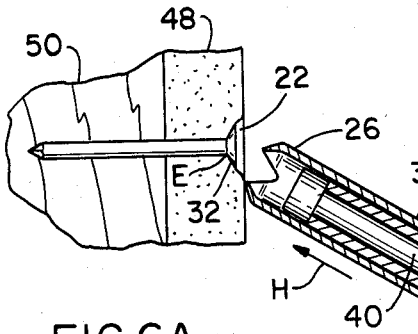
Figure 6B:
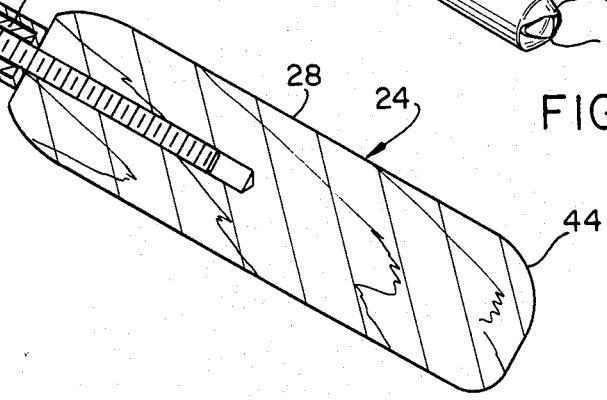
Figure 6B:
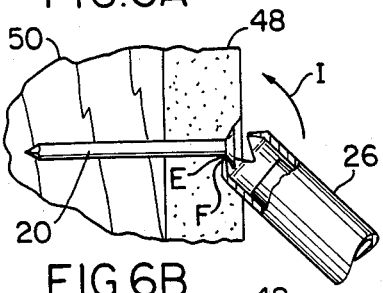
Figure 6C:
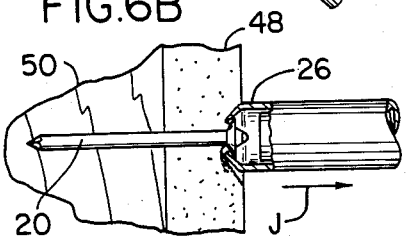
Figure 6D:
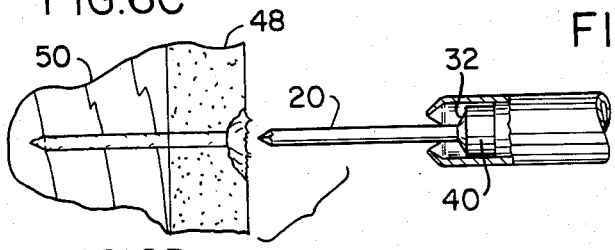
Figure 7:
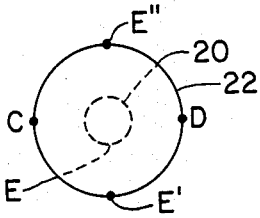

FIGS. 6A–D are respectively a showing of the sequence of the manner in which the inventive tool is utilized to remove a nail from sheet rock or the like, wherein more particularly in FIG. 6A the tool initially engages the nail; in FIG. 6B, the engagement is established under the nailhead; in FIG. 6C, the tool is rotated into a position that is in line with the ultimate direction of pulling removal of the nail; and in FIG. 6D, the removal is achieved; and FIG. 7 is a plan view of the nail and its head.

Figure 1:
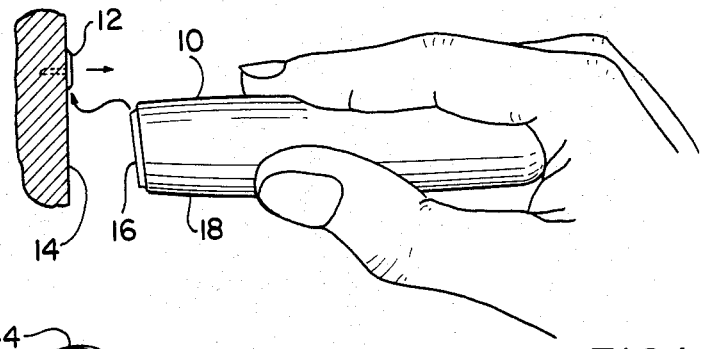
FIG.1 PRIOR ART
FIG. 1 is a front elevational view of a prior art device used for removing tacks, in which the device is shown just preparatory to being placed in use.

In prior art FIG. 1 is shown a tool 10 used to extract tacks 12 from a wall or other surface 14. In prior art FIG. 1, the device illustrated may be that of U.S. Pat. No. 3,218,030 issued on Nov. 16, 1965 to J. Baro, in which a pair of thin, parallel blades 16, supported on handle 18, can be slipped beneath the flange head of tack 12, and a prying or pulling action of tool 10 will then cause the shaft of the tack 12 to be withdrawn from the surface 14.

Figure 2:
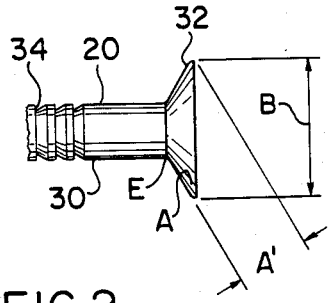
FIG. 2 is a partial side elevational view of a typical nail used to secure sheet rock to building studs.

Quite often, in the building industry, the craftsman is required to extract a nail 20, of the type shown in FIG. 2, from studding and/or sheet rock with a minimum of damage to the sheet rock material. Most of the time, the head of the nail is below the material surface, as shown at 22 in FIG. 6A, and unavailable to the ready grasp of a claw hammer. In addition, perhaps even more important, a removal tool such as illustrated and briefly described in connection with FIG. 1, is inadequate structurally to remove a nail 20 having a length of shaft as shown in FIG. 6A, which shaft length contributes to creating considerable frictional force which resists removal. In this regard, the prior art tool of FIG. 1 is structurally inadequate since each blade 16 must be relatively thin in order to slip under the nailhead and, in any event, because of its mode of use in which it is slipped under the nailhead, there must be an opening at one end of the slot which is defined between the blades, and this end opening is an obvious structural weakness.

Figure 3:
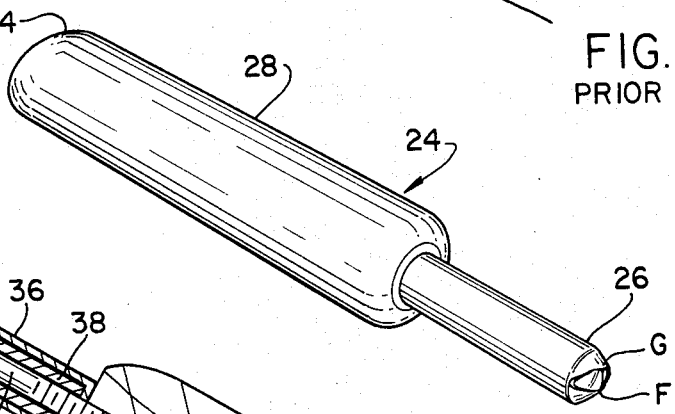
FIG. 3 is a perspective view of the inventive nail removal tool according to the present invention.

FIG. 3 shows a tool 24, according to the present invention, in which a tip 26 is supported on a handle 28. This structurally different tool, now to be described, can be used to extract nails with a minimum of damage to the sheet rock material, and has more than sufficient structural strength to remove nails, even with comparatively long shafts and despite the frictional force which resists removal.

FIG. 2 is a detailed view of the head end of a barbed sheet rock nail 20. The shape of the nail may have barbs 34. The head 32 of the nail 20 may be conical. This type head has a diameter B and when viewed from the side at angle A has a profile height A', which is much less than diameter B. Typically, if angle A is 30°, then height A' is approximately 0.5 of diameter B. Thus, a typical nail 20 as just described offers considerably more resistance to pulling removal than a typical tack 12.

In FIG. 6A, tool 24 is shown in full section. Tip 26 is comprised of outer sleeve 36, spacer-like inner sleeve 38 and Allen Screw 40 used to secure the tip 26 to a wood or plastic handle 28. Handle 28 may have an area 44 of increased radius on the top side to ease the pressure on the user's palm.

Figure 4:
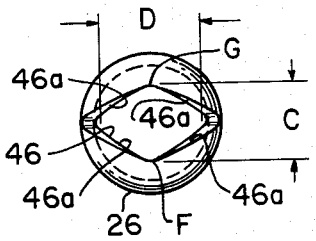
FIG. 4 is a front elevational view, on an enlarged scale, of the front tip of the tool in which more particularly there is illustrated a front opening in this end of the tool.
Figure 5:
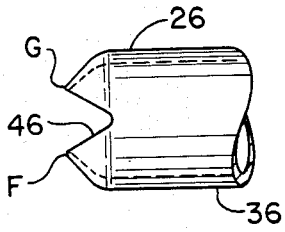
FIG. 5 is a side elevational view projected from FIG. 4.

FIG. 4 presents a close look at the end opening 46 of tip 26 which is basically a diamond shape. Width D, or the long dimension of the diamond shape, is dimensioned to be larger than dimension B of FIG. 2. Dimension C, or the short dimension of the diamond shape, is proportioned to be slightly larger than dimension A of FIG. 2, but much smaller than dimension B of FIG. 2. The wall of sleeve 36 has been rolled inward and shaped. Thinning of said wall towards its outer edge (see FIG. 5) results in a somewhat sharpened edge at points G and F suitable for gouging, and also in gouging edges about opening 46 which individually and collectively are designated 46A.

Reference is now made to FIGS. 6A–D wherein the use of the tool 24 will be more particularly explained. Throughout these figures, nail 20 is used to hold sheet rock 48 to stud 50. In FIG. 6A, the point F of tip 26 is shown placed in proximity to head 32 of nail 20. The access of the tool 24 is held at about a 45° angle to the sheet rock 48 and force is applied in a direction of arrow H. Since the sheet rock 48 is crumbly by nature, it is intended that point F on tip 26 will gouge its way to point E at the juncture of shaft 30 and head 32 of nail 20. With point F now in position on point E as shown in FIG. 6B, tool 24 is rotated approximately 45 degrees in a counter-clockwise direction, as shown by arrow I in FIG. 6B, until the tool 24 and nail 20 become co-axial. As a consequence of this rotation, point G of tip 26 will gouge sheet rock 48 and find its way around nailhead 32. Next, a pulling force J is applied to tool 24, as shown in FIG. 6C, and this results in the withdrawal of nail 20 from stud 50 and from the sheet rock 48 supported thereon, all as shown in FIG. 6D, and all, it will be understood, with a minimum of damage to the materials. Still referring to FIG. 6D, it should be noted that head 32 of nail 20 is in contact with Allen Screw 40. This is shown as an optional feature wherein screw 40 and/or sleeve 38 may be permanently magnetized to insure that nail 20 remains captive within tip 26 after extraction.

Although from the description just provided, it should be readily understood how the nailhead 22 is caused to enter and remain within the tool end opening 46, another explanation thereof in connection with the nailhead 22 might be helpful and is provided in connection with FIG. 7, as well as with previously described FIG. 4.

The nailhead from peripheral reference point E' to opposite reference points C and D is outwardly diverging, i.e., increasing in size, and from points C and D to the remote opposite reference point E'' is inwardly diverging, i.e., diminishing in size.

The size D of the opening 46 is greater than the dimension C-D of the nailhead at point E, as shown in FIG. 6B. Thus, upon initial rotation I, the dimension D clears the dimension C-D of the nailhead. Then, upon continued rotation of the tool, the tool point F backs off of the shank at point E towards the peripheral point E' of the nailhead. This locates a reduced size of the tool opening, (which is that dimension of the tool opening just beyond the dimension D in the direction of the point G), under the nailhead medial size C-D. This necessarily must occur since, as already noted, the tool dimension D cleared the dimension C-D of the nailhead upon the initial rotation I, and thus is clearly past the nailhead dimension C-D and, by being "past", is in a condition to be withdrawn under the nailhead dimension C-D, and thus to occupy a position under the nailhead 22.

As a result of the foregoing, it is thus possible to pull on the tool in the direction of the longitudinal axis of the nail shank 20 and, since the nailhead is engaged in the tool end opening 46, the nail is removed by this pulling force, all as is clearly illustrated in FIG. 6D.

If the need arises to extract nail 20 from a material harder than sheet rock, for instance wood, then it is possible to use tool 24 in a slightly different way. Point F of tip 26 can be gouged into the wood as explained for the sheet rock. Since wood has better bearing characteristics than sheet rock, once entry is made under the head 32 by point F, then the tool can be used to pry or jimmy the nail 20 into a position slightly removed from the surface of the material 48. The nailhead 22 of the nail 20 is then removed using the tool 24 hereof following the same sequence illustrated in FIGS. 6B, 6C, and 6D.

While the particular nail removal method and apparatus herein shown and described in detail is fully capable of attaining the objects and providing the advantages hereinbefore stated, it is to be understood that it is merely illustrative of the presently preferred embodiment of the invention and that no limitations are intended to the detail of constructional design herein shown other than as defined in the appended claims.

What is claimed is:

1. A device for extracting a nail having a shank and a round nailhead of a prescribed diameter from a material in which it is embedded with minimum marring of the surface of said material, said device comprising a handle having a body-supporting member extending therefrom, a body in the form of a hollow tubular member with opposite end openings bounding an internal compartment mounted on said body-supporting member by having said body-supporting member projected through one end opening into said internal compartment, and at said other body end opening a nail-extracting means, said nail-extracting means consisting of a diamond shape in said other end opening in said distal body sized with respect to the diameter of said nailhead such that both the longest dimension thereof and the width at the medial location of said diamond shape in larger than said nailhead diameter and the width thereof is then progressively smaller in dimension, whereby from an initial operative position in which said device is angularly inclined relative to said nail shank and in which said round nailhead is only partially projected into said diamond-shaped opening a subsequent pivotal traverse of said device to a position coaxial with said nail shank causes said diamond-shaped opening to close over said round nailhead and the difference in said round and diamond shapes is effective to thereby cause the nail-extracting diamond-shaped opening and round nailhead to interengage with each other preparatory to the pulling removal of said engaged nail by said extracting device.

2. A nail-extracting device, as claimed in claim 1, wherein the edges bounding said diamond-shaped opening are tapered to a knife-like configuration, to thereby permit selective gouging of the surface of said nail-embedding material, to thereby facilitate the engagement of said nailhead by said device.

* * * * *